US009978307B2

(12) United States Patent
Yang

(10) Patent No.: US 9,978,307 B2
(45) Date of Patent: May 22, 2018

(54) ORGANIC LIGHT EMITTING DISPLAY AND DRIVING METHOD THEREOF

(71) Applicant: SAMSUNG DISPLAY CO., LTD., Yongin, Gyeonggi-Do (KR)

(72) Inventor: Jin-Wook Yang, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 2 days.

(21) Appl. No.: 14/708,102

(22) Filed: May 8, 2015

(65) Prior Publication Data

US 2016/0019844 A1 Jan. 21, 2016

(30) Foreign Application Priority Data

Jul. 18, 2014 (KR) ..... 10-2014-0091097

(51) Int. Cl.
*G09G 5/00* (2006.01)
*G09G 3/3233* (2016.01)

(52) U.S. Cl.
CPC ... *G09G 3/3233* (2013.01); *G09G 2300/0443* (2013.01); *G09G 2300/0861* (2013.01); *G09G 2310/0251* (2013.01); *G09G 2310/0262* (2013.01)

(58) Field of Classification Search
CPC ..... G09G 3/3291; G09G 5/10; G09G 5/18; G09G 2300/0861; G09G 2310/0251; G09G 2310/0261
USPC ..... 345/76–95, 690, 204–214; 315/169.3; 1/1; 324/76.11
See application file for complete search history.

(56) References Cited

U.S. PATENT DOCUMENTS 7,495,646 B2 * 2/2009 Kawabe ..... G09G 3/342 345/95
7,773,056 B2 * 8/2010 Kwak ..... G09G 3/3233 315/169.3
7,920,113 B2 * 4/2011 Um ..... G02F 1/136213 345/100
8,379,063 B2 * 2/2013 Budni ..... G09G 3/02 345/690
8,619,011 B2 * 12/2013 Kimura ..... G02F 1/13624 345/90
8,754,882 B2 * 6/2014 Maekawa ..... G09G 3/3233 345/211
9,035,976 B2 * 5/2015 Lee ..... G09G 3/3283 345/691
9,129,923 B1 * 9/2015 Han ..... H01L 27/3248
9,324,777 B2 * 4/2016 Kang ..... G09G 3/3225
9,423,602 B1 * 8/2016 Dolgoff ..... G02B 21/22
2001/0048408 A1 * 12/2001 Koyama ..... G09G 3/30 345/76

(Continued)

FOREIGN PATENT DOCUMENTS

KR 10-2012-0009904 A 2/2012
KR 10-2014-0008399 A 1/2014

(Continued)

*Primary Examiner* — Prabodh M Dharia
(74) *Attorney, Agent, or Firm* — Lewis Roca Rothgerber Christie LLP

(57) ABSTRACT

An organic light emitting display includes: a first pixel; and a second pixel adjacent to the first pixel, the second pixel being configured to emit light at a different time from the first pixel, wherein the first pixel and the second pixel share a storage capacitor configured to store a voltage of a data signal.

20 Claims, 6 Drawing Sheets

(56) References Cited

U.S. PATENT DOCUMENTS

2003/0169247 A1* 9/2003 Kawabe ..... G09G 3/342 345/204
2006/0097972 A1* 5/2006 Takeuchi ..... G02F 1/136213 345/90
2007/0040795 A1* 2/2007 Lee ..... G09G 3/3648 345/100
2007/0118781 A1* 5/2007 Kim ..... G09G 3/3233 714/727
2007/0241999 A1* 10/2007 Lin ..... G09G 3/2014 345/76
2008/0062340 A1* 3/2008 Um ..... G02F 1/136213 349/38
2008/0088547 A1* 4/2008 Chan ..... G09G 3/3233 345/76
2008/0111777 A1* 5/2008 Kim ..... G09G 3/3233 345/83
2008/0111837 A1* 5/2008 Kim ..... G09G 3/2022 345/690
2008/0136765 A1* 6/2008 Neugebauer ..... G02F 1/13624 345/98
2008/0170008 A1* 7/2008 Kim ..... G09G 3/2003 345/76
2008/0174530 A1* 7/2008 Booth ..... G09G 3/3208 345/82
2008/0252217 A1* 10/2008 Kim ..... G09G 3/3233 315/51
2008/0259064 A1* 10/2008 Chiou ..... G09G 3/3233 345/205
2009/0146987 A1* 6/2009 Kim ..... G09G 3/3233 345/212
2010/0007594 A1* 1/2010 Lai ..... G02F 1/136213 345/98
2011/0085099 A1* 4/2011 Kim ..... G02F 1/133707 349/39
2011/0109299 A1* 5/2011 Chaji ..... G09G 3/3283 324/76.11
2011/0109350 A1* 5/2011 Chaji ..... G09G 3/3283 327/108
2011/0109612 A1* 5/2011 Chaji ..... G09G 3/3283 345/211
2011/0193856 A1* 8/2011 Han ..... G09G 3/3233 345/214
2012/0019498 A1 1/2012 Jeong
2012/0105495 A1* 5/2012 Choi ..... G09G 3/3233 345/690
2012/0105496 A1* 5/2012 Komiya ..... G09G 3/003 345/690
2013/0141412 A1* 6/2013 Kang ..... G09G 3/3233 345/212
2014/0022289 A1 1/2014 Lee et al.
2014/0354621 A1* 12/2014 Shin ..... G09G 3/3696 345/212
2015/0302828 A1* 10/2015 Chaji ..... G09G 3/3283 345/213

FOREIGN PATENT DOCUMENTS

KR 10-2014-0013146 A 2/2014
WO WO 2012/114059 A2 8/2012

* cited by examiner

ORGANIC LIGHT EMITTING DISPLAY AND DRIVING METHOD THEREOF

CROSS-REFERENCE TO RELATED APPLICATION

This application claims priority to and the benefit of Korean Patent Application No. 10-2014-0091097, filed on Jul. 18, 2014, in the Korean Intellectual Property Office, the entire contents of which are incorporated herein by reference in their entirety.

BACKGROUND

1. Field

Aspects of embodiments of the present invention relate to an organic light emitting display and a driving method thereof.

2. Description of the Related Art

With development of information technology, the importance of display devices, acting as a medium connecting information and users, has been emphasized. Use of flat panel displays (FPDs), such as liquid crystal displays, organic light emitting diode displays, plasma display panels, etc., is also on the rise.

Organic light emitting displays, among FPDs, display images using organic light emitting diodes (OLEDs) which generate light by electron-hole recombination. Organic light emitting displays exhibit fast response times and low power consumption.

SUMMARY

Aspects of embodiments of the present invention provide an organic light emitting display and a driving method thereof capable of enhancing lifespan.

According to an embodiment, an organic light emitting display includes: a first pixel; and a second pixel adjacent to the first pixel, the second pixel being configured to emit light at a different time from the first pixel. The first pixel and the second pixel share a storage capacitor configured to store a voltage of a data signal.

The first pixel and the second pixel may be configured to emit light alternatively with respect to a frame.

The organic light emitting display may further include: a scan driver configured to supply a first scan signal to a first scan line coupled to the first pixel and the second pixel, and to supply a second scan signal to a second scan line coupled to the first pixel and the second pixel; an emission driver configured to supply a first light emitting control signal to a first light emitting control line coupled to the first pixel and the second pixel, and to supply a second light emitting control signal to a second light emitting control line coupled to the first pixel and the second pixel; and a data driver configured to supply the data signal to a data line coupled to the first pixel and the second pixel.

The scan driver may be configured to supply the first scan signal to the first scan line during an i-th frame period, where i is an odd or even number, and to supply the second scan signal to the second scan line during an (i+1)-th frame period.

The emission driver may be configured to supply the first light emitting control signal to the first light emitting control line after the first scan signal is supplied, and to supply the second light emitting control signal to the second light emitting control line after the second scan signal is supplied.

The data driver may be configured to supply the data signal corresponding to the first pixel to the data line when the first scan signal is supplied, and to supply a data signal corresponding to the second pixel to the data line when the second scan signal is supplied.

The first pixel may include: a first organic light emitting diode; and a first driving transistor configured to control an amount of current flowing from a first power source to a second power source via the first organic light emitting diode corresponding to a voltage applied to a first node, and the second pixel may include: a second organic light emitting diode; and a second driving transistor configured to control an amount of current flowing from the first power source to the second power source via the second organic light emitting diode corresponding to a voltage applied to a second node.

The storage capacitor may be coupled between the first node and the second node.

The first pixel may further include: a first transistor coupled between an anode electrode of the first organic light emitting diode and an initialization power source set to a voltage lower than that of the second power source, the first transistor being configured to be turned on when the second light emitting control signal is supplied; a second transistor coupled between the data line and the first node, and configured to be turned on when the first scan signal is supplied; a third transistor coupled between the first power source and the first node, and configured to be turned on when the second light emitting control signal is supplied; a fourth transistor coupled between the first driving transistor and the anode electrode of the first light emitting diode, and configured to be turned on when the first light emitting control signal is supplied; and a fifth transistor coupled between a reference power source set to a voltage higher than that of the first power source and the first node, the fifth transistor being configured to be turned on when the second scan signal is supplied.

The second pixel may further include: a first transistor coupled between an anode electrode of the second organic light emitting diode and an initialization power source set to a voltage lower than that of the second power source, the first transistor being configured to be turned on when the first light emitting control signal is supplied; a second transistor coupled between the data line and the second node, and configured to be turned on when the second scan signal is supplied; a third transistor coupled between the first power source and the second node, and configured to be turned on when the first light emitting control signal is supplied; a fourth transistor coupled between the second driving transistor and the anode electrode of the second organic light emitting diode, and configured to be turned on when the second light emitting control signal is supplied; and a fifth transistor coupled between a reference power source set to a voltage equal to or higher than that of the first power source and the second node, the fifth transistor being configured to be turned on when the first scan signal is supplied.

The organic light emitting display may further include: a scan driver configured to supply a first scan signal to a first scan line coupled to the first pixel and the second pixel, and to supply a second scan signal to a second scan line coupled to the first pixel and the second pixel; an emission driver configured to supply a first emitting control signal to a first light emitting control line coupled to the first pixel and the second pixel, and to supply a second light emitting control signal to a second light emitting control line coupled to the first pixel and the second pixel; and a data driver configured to supply a first data signal to a first data line coupled to the first pixel, and to supply a second data signal to a second data line coupled to the second pixel.

The scan driver may be configured to supply the first scan signal to the first scan line during an i-th frame and an (i+1)-th frame period, where i is an odd or even number, and to supply the second scan signal to the second scan line so that the second scan signal is synchronized with the first scan signal.

The emission driver may be configured to supply the first light emitting control signal to the first light emitting control line after the first scan signal is supplied during the i-th frame period, and to supply the second light emitting control signal to the second light emitting control line after the second scan signal is supplied during the (i+1)-th frame period.

The data driver may be configured to supply, during the i-th frame period, the first data signal, corresponding to a desired brightness, to the first data line, and the second data signal, corresponding to a black gray level, to the second data line; and the data driver may be configured to supply, during the (i+1)-th frame period, the first data signal, corresponding to the black gray level, to the first data line, and the second data signal, corresponding to the desired brightness, to the second data line.

The first pixel may include: a first organic light emitting diode; and a first driving transistor configured to control an amount of current flowing from a first power source to a second power source via the first organic light emitting diode corresponding to a voltage applied to a first node, and the second pixel may include: a second organic light emitting diode; and a second driving transistor configured to control an amount of current flowing from the first power source to the second power source via the second organic light emitting diode corresponding to a voltage applied to a second node.

The storage capacitor may be coupled between the first node and the second node.

The first pixel may further include: a first transistor coupled between an anode electrode of the first organic light emitting diode and an initialization power source set to a voltage lower than that of the second power source, the first transistor being configured to be turned on when the second organic light emitting control signal is supplied; a second transistor coupled between the first data line and the first node, and configured to be turned on when the first scan signal is supplied; a third transistor coupled between the first power source and the first node, and configured to be turned on when the second light emitting control signal is supplied; and a fourth transistor coupled between the first driving transistor and the anode electrode of the first organic light emitting diode, and configured to be turned on when the first light emitting control signal is supplied.

The second pixel may further include: a first transistor coupled between an anode electrode of the second organic light emitting diode and an initialization power source set to a voltage lower than that of the second power source, the first transistor being configured to be turned on when the first organic light emitting control signal is supplied; a second transistor coupled between the second data line and the second node, and configured to be turned on when the second scan signal is supplied; a third transistor coupled between the first power source and the second node, and configured to be turned on when the first light emitting control signal is supplied; and a fourth transistor coupled between the second driving transistor and the anode electrode of the second organic light emitting diode, and configured to be turned on when the second light emitting control signal is supplied.

According to another embodiment, a method for driving an organic light emitting display includes: emitting light from a first pixel during an i-th frame period, where i is an odd or even number; and emitting light from a second pixel, sharing a storage capacitor with the first pixel, during an (i+1)-th frame period.

A light emitting time of the first pixel and a light emitting time of the second pixel may not overlap each other.

BRIEF DESCRIPTION OF THE DRAWINGS

Aspects of example embodiments will now be described more fully hereinafter with reference to the accompanying drawings. However, aspects of the present invention may be embodied in various different forms and should not be construed as limited to the embodiments set forth herein. Rather, these embodiments are provided so that this disclosure will be thorough and complete, and will fully convey the spirit and scope of the present invention to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout. Further, when a first element is referred to as being coupled or connected to a second element, the first element may be directly coupled or connected to the second element or may be indirectly coupled or connected to the second element through one or more intervening elements.

DETAILED DESCRIPTION

Hereinafter, reference will now be made in detail to embodiments of the present invention, examples of which are illustrated in the accompanying drawings. As used herein, the term "and/or" includes any and all combinations of one or more of the associated listed items.

Figure 1:
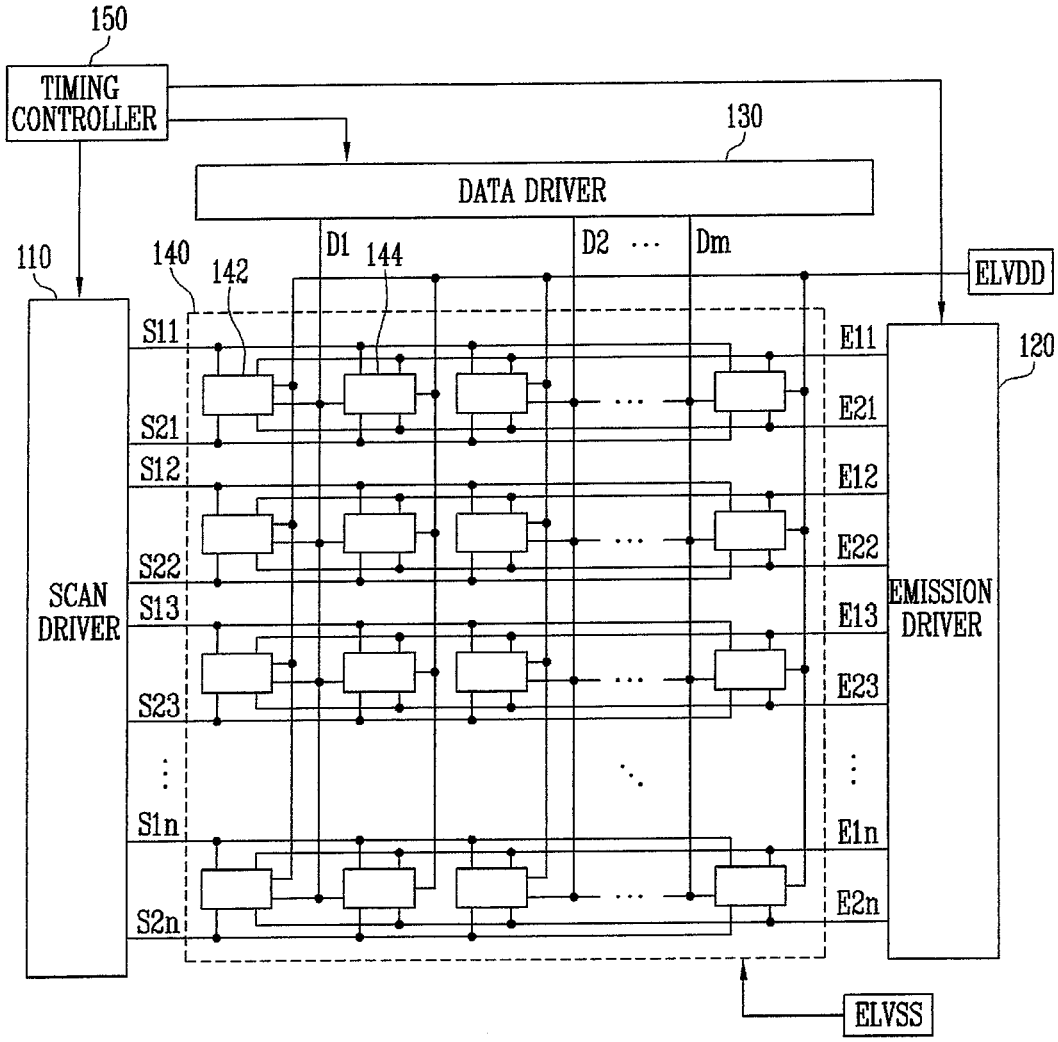
FIG. 1 illustrates an organic light emitting display according to a first embodiment.

FIG. 1 illustrates an organic light emitting display according to a first embodiment.

Referring to FIG. 1, the organic light emitting display according to the first embodiment may include a scan driver 110, an emission driver 120, a data driver 130, a display unit 140 including first pixels 142 and second pixels 144, and a timing controller 150.

The scan driver 110 may drive first scan lines S11 to S1*n* and second scan lines S21 to S2*n* formed in (e.g., extending in) a first direction (e.g., a horizontal direction). The scan driver 110 may sequentially supply first scan signals to the first scan lines S11 to S1*n* during an i-th frame period (where i is an odd or even number), and may sequentially supply second scan signals to the second scan lines S21 to S2*n* during an (i+1)-th frame period.

The emission driver 120 may drive first light emitting control lines E11 to E1*n* and second light emitting control lines E21 to E2*n* formed in (e.g., extending in) the first direction. The emission driver 120 may sequentially supply first light emitting control signals to the first light emitting control lines E11 to E1*n* during the i-th frame period, and may sequentially supply second light emitting control signals to the second light emitting control lines E21 to E2*n* during the (i+1)-th frame period.

A first light emitting control signal supplied to a j-th first light emitting control line E1*j* (where j is a natural number) does not overlap a first scan signal supplied to a j-th first scan line S1*j*, and may be supplied after the first scan signal is supplied. A second light emitting control signal supplied to a j-th second light emitting control line E2*j* does not overlap a second scan signal supplied to a j-th second scan line S2*j*, and may be supplied after the second scan signal is supplied. The first scan signal, the second scan signal, the first light emitting control signal, and the second light emitting control signal may be set to voltages (e.g., low voltages) at which transistors included in the pixels 142 and 144 can be turned on.

The data driver 130 may supply data signals to data lines D1 to Dm formed in (e.g., extending in) a second direction (e.g., vertical direction) crossing the first direction. For example, the data driver 130 may supply first data signals to the data lines D1 to Dm during the i-th frame period, and may supply second data signals to the data lines D1 to Dm during the (i+1)-th frame period. The first data signals may refer to data signals supplied to the first pixels 142, and the second data signals may refer to data signals supplied to the second pixels 144.

The display unit 140 may include the first pixels 142 and the second pixels 144 configured to emit light alternatively with respect to a frame (e.g., one frame period). The first pixels 142 may emit light corresponding to the first data signals input during the i-th frame period, and the second pixels 144 may emit light corresponding to the second data signals input during the (i+1)-th frame period. The first pixel 142 and the second pixel 144 that are adjacent to each other may share a storage capacitor configured to store data signals. The first pixel 142 and the second pixel 144 that are adjacent to each other may be coupled to a same data line (e.g., any one of data lines D1 to Dm). More detailed description will be provided below with reference to a circuit configuration of the pixels 142 and 144.

The timing controller 150 may control the scan driver 110, the emission driver 120, and the data driver 130.

In FIG. 1, the scan driver 110 and the emission driver 120 are illustrated as separate drivers, but the present invention is not limited thereto. For example, the scan driver 110 and the emission driver 120 may be formed as one driver. Also, in FIG. 1, although the first pixel 142 and the second pixel 144 are illustrated as being adjacent to each other and provided on a same horizontal line, the present invention is not limited thereto. For example, the first pixel 142 and the second pixel 144 may be provided to be adjacent to each other on a same vertical line.

Figure 2:
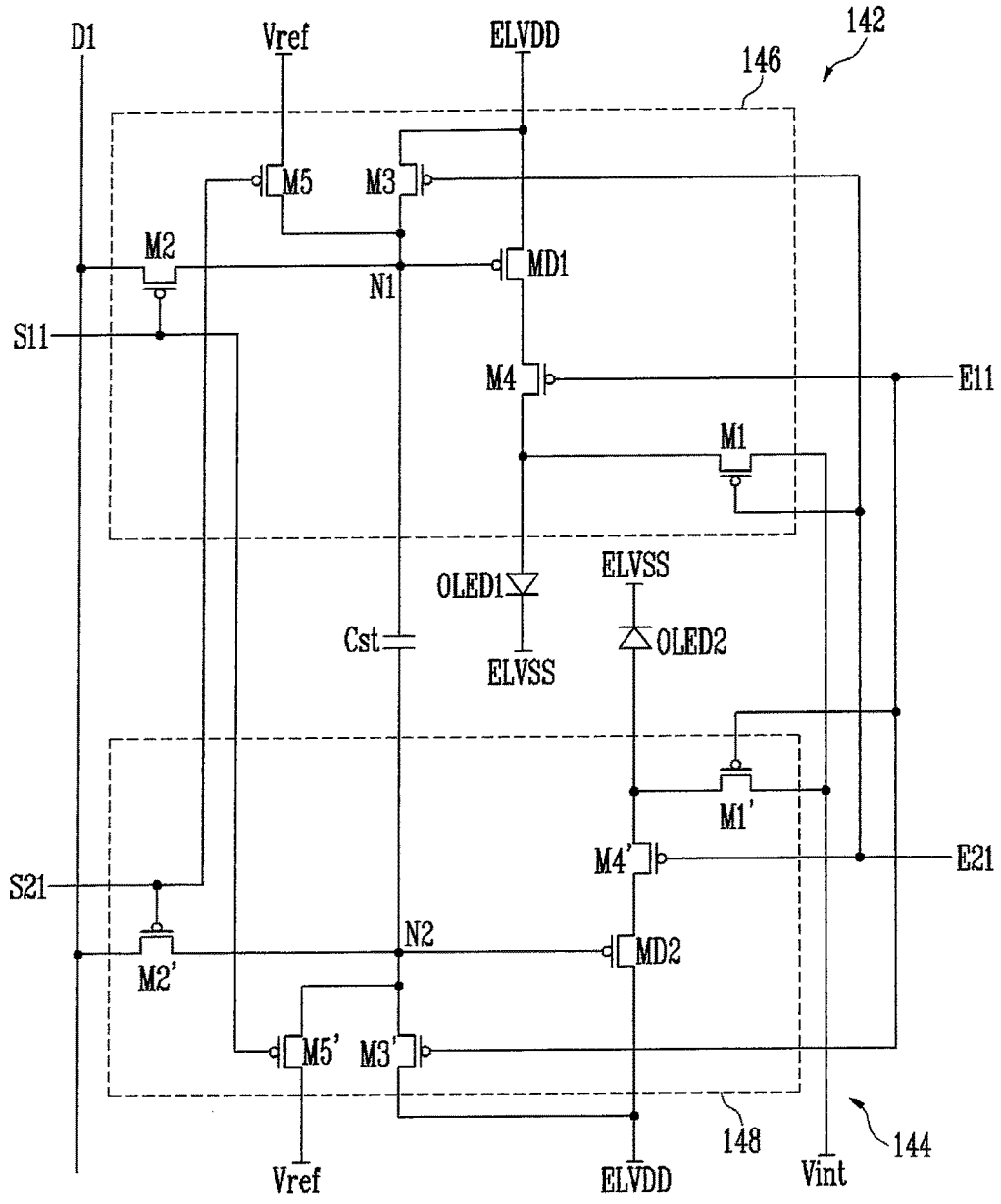
FIG. 2 is a circuit diagram illustrating configurations of a first pixel and a second pixel according to the first embodiment.

FIG. 2 is a circuit diagram illustrating configurations of a first pixel and a second pixel according to the first embodiment. In FIG. 2, for convenience of illustration, a first pixel 142 and a second pixel 144 coupled to a first data line D1, a first first scan line S11, and a first second scan line S21 are illustrated.

Referring to FIG. 2, the first pixel 142 according to the first embodiment may include a first pixel circuit 146 and a first organic light emitting diode OLED1. The second pixel 144 may include a second pixel circuit 148 and a second organic light emitting diode OLED2.

The first organic light emitting diode OLED1 may generate light having a brightness (e.g., a predetermined brightness) corresponding to an amount of current supplied from the first pixel circuit 146.

The second organic light emitting diode OLED2 may generate light having a brightness (e.g., a predetermined brightness) corresponding to an amount of current supplied from the second pixel circuit 148.

The first pixel circuit 146 may control the amount of the current supplied to the first organic light emitting diode OLED1 corresponding to a first data signal supplied from the data line D1. The first pixel circuit 146 may include a first driving transistor MD1, and first through fifth transistors M1, M2, M3, M4, and M5.

The first driving transistor MD1 may be coupled between a first power source ELVDD and an anode electrode of the first organic light emitting diode OLED1. A gate electrode of the first driving transistor MD1 may be coupled to a first node N1. The first driving transistor MD1 may control an amount of current flowing from the first power source ELVDD to a second power source ELVSS via the first organic light emitting diode OLED1 corresponding to a voltage at the first node N1. The first power source ELVDD may be set to a voltage higher than that of the second power source ELVSS.

The first transistor M1 may be coupled between the anode electrode of the first organic light emitting diode OLED1 and an initialization power source Vint. A gate electrode of the first transistor M1 may be coupled to a first second light emitting control line E21. The first transistor M1 may be turned on when a second light emitting control signal is supplied to the first second light emitting control line E21, and may supply a voltage of the initialization power source Vint to the anode electrode of the first organic light emitting diode OLED1. The initialization power source Vint may be set to a voltage lower than that of the second power source ELVSS. When the voltage of the initialization power source Vint is supplied to the anode electrode of the first organic light emitting diode OLED1, the first organic light emitting diode OLED1 may be initialized to a reverse bias state. When the first organic light emitting diode OLED1 is initialized to the reverse bias state, degradation characteristics may be improved, thereby causing lifespan to be enhanced.

The second transistor M2 may be coupled between the data line D1 and the first node N1. A gate electrode of the second transistor M2 may be coupled to the first first scan line S11. The second transistor M2 may be turned on when a first scan signal is supplied to the first first scan line S11, and may electrically couple the data line D1 to the first node N1.

The third transistor M3 may be coupled between the first power source ELVDD and the first node N1. A gate electrode of the third transistor M3 may be coupled to the first second light emitting control line E21. The third transistor M3 may be turned on when a second light emitting control signal is supplied to the first second light emitting control line E21, and may supply the voltage of the first power source ELVDD to the first node N1.

The fourth transistor M4 may be coupled between the first driving transistor MD1 and the anode electrode of the first organic light emitting diode OLED1. A gate electrode of the fourth transistor M4 may be coupled to a first first light emitting control line E11. The fourth transistor M4 may be turned on when the first light emitting control signal is supplied to the first first light emitting control line E11, and may electrically couple the first driving transistor MD1 to the first organic light emitting diode OLED1.

The fifth transistor M5 may be coupled between a reference power source Vref and the first node N1. A gate electrode of the fifth transistor M5 may be coupled to the first second scan line S21. The fifth transistor M5 may be turned on when a second scan signal is supplied to the first second scan line S21, and may supply a voltage of the reference power source Vref to the first node N1. The reference power source Vref may be set to a voltage greater than or equal to that of the first power source ELVDD. For example, the voltage of the first power source ELVDD may be used as the reference power source Vref.

The second pixel circuit 148 may control an amount of current supplied to the second organic light emitting diode OLED2 corresponding to a second data signal supplied from the data line D1. The second pixel circuit 148 may include a second driving transistor MD2, and first through fifth transistors M1', M2', M3', M4', and M5'.

The second driving transistor MD2 may be coupled between the first power source ELVDD and an anode electrode of the second organic light emitting diode OLED2. A gate electrode of the second driving transistor MD2 may be coupled to a second node N2. The second driving transistor MD2 may control an amount of current supplied from the first power source ELVDD to the second power source ELVSS via the second organic light emitting diode OLED2 corresponding to a voltage at the second node N2.

The first transistor M1' may be coupled between the anode electrode of the second organic light emitting diode OLED2 and the initialization power source Vint. A gate electrode of the first transistor M1' may be coupled to the first first light emitting control line E11. The first transistor M1' may be turned on when the first light emitting control signal is supplied to the first first light emitting control line E11, and may supply the voltage of the initialization power source Vint to the anode electrode of the second organic light emitting diode OLED2.

The second transistor M2' may be coupled between the data line D1 and the second node N2. A gate electrode of the second transistor M2' may be coupled to the first second scan line S21. The second transistor M2' may be turned on when the second scan signal is supplied to the first second scan line S21, and may electrically couple the data line D1 to the second node N2.

The third transistor M3' may be coupled between the first power source ELVDD and the second node N2. A gate electrode of the third transistor M3' may be coupled to the first first light emitting control line E11. The third transistor M3' may be turned on when the first light emitting control signal is supplied to the first first light emitting control line E11, and may supply the voltage of the first power source ELVDD to the second node N2.

The fourth transistor M4' may be coupled between the second driving transistor MD2 and the anode electrode of the second organic light emitting diode OLED2. A gate electrode of the fourth transistor M4' may be coupled to the first second light emitting control line E21. The fourth transistor M4' may be turned on when the second light emitting control signal is supplied to the first second light emitting control line E21, and may electrically couple the second driving transistor MD2 to the second organic light emitting diode OLED2.

The fifth transistor M5' may be coupled between the reference power source Vref and the second node N2. A gate electrode of the fifth transistor M5' may be coupled to the first first scan line S11. The fifth transistor M5' may be turned on when the first scan signal is supplied to the first first scan line S11, and may supply the voltage of the reference power source Vref to the second node N2.

A storage capacitor Cst may be coupled between the first node N1 and the second node N2. The storage capacitor Cst may be shared by the first pixel circuit 146 and the second pixel circuit 148, and may store a voltage of the first data signal or the second data signal.

Figure 3A:
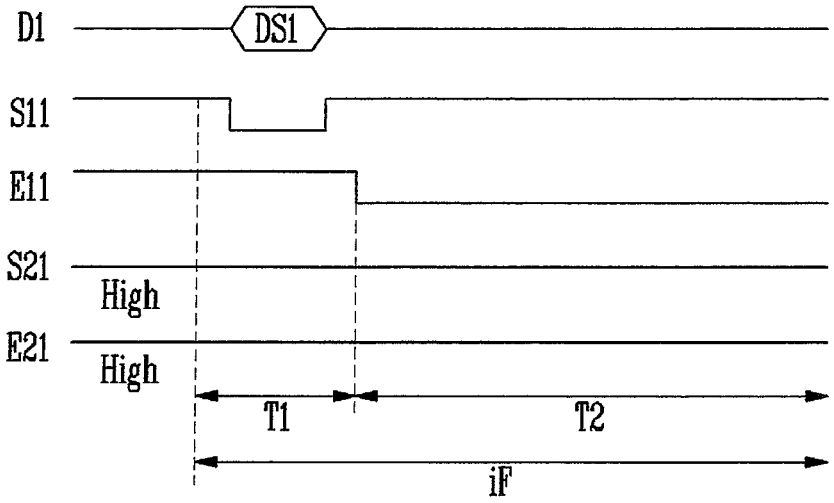
FIGS. 3A and 3B are timing diagrams illustrating a method for driving the first pixel and the second pixel shown in FIG. 2.
Figure 3B:
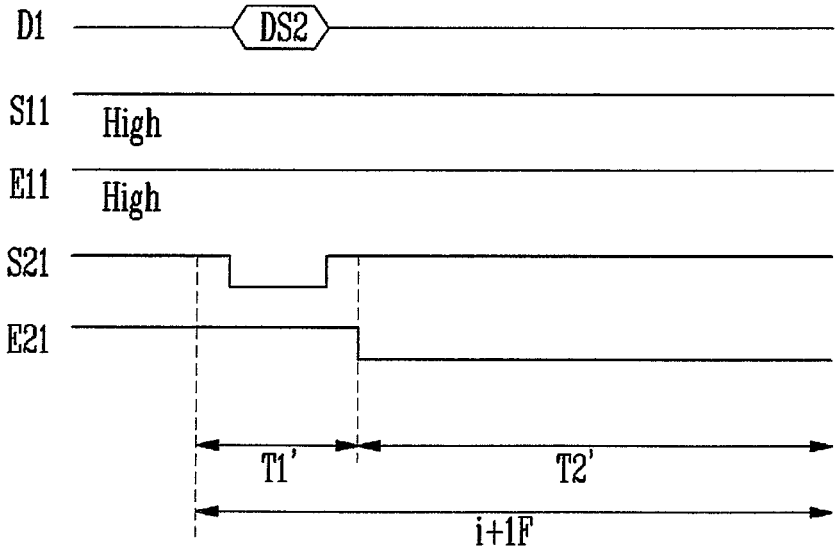

FIGS. 3A and 3B are timing diagrams illustrating a method for driving the first pixel and the second pixel shown in FIG. 2. FIG. 3A illustrates the timing diagram supplied during an i-th frame iF period, and FIG. 3B illustrates the timing diagram supplied during an (i+1)-th frame i+1F period.

During a first period T1 of the i-th frame iF period, the first scan signal may be supplied to the first first scan line S11. When the first scan signal is supplied to the first first scan line S11, the second transistor M2 and the fifth transistor M5' may be turned on. When the second transistor M2 is turned on, the first data signal DS1 may be supplied from the data line D1 to the first node N1.

When the fifth transistor M5' is turned on, the voltage of the reference power source Vref may be supplied to the second node N2. The storage capacitor Cst may is store a voltage corresponding to a difference between the reference power source Vref and the first data signal DS1. Thus, a desired voltage may be stored in the storage capacitor Cst in a stable manner, regardless of a voltage drop of the first power source ELVDD.

For example, when the first power source ELVDD supplies current to the pixels 142 and 144, a voltage drop (e.g., a predetermined voltage drop) corresponding to a location of the pixels 142 and 144 may occur. Accordingly, if the storage capacitor Cst is charged corresponding to a difference between the first power source ELVDD and the first data signal DS1, a desired voltage may not be charged. On the other hand, the reference power source Vref may not supply current to the pixels 142 and 144. Thus, a constant voltage may be set regardless of the locations of the pixels 142 and 144. Therefore, when the storage capacitor Cst stores the voltage corresponding to the difference between the reference power source Vref and the first data signal DS1, a desired voltage may be stored in the storage capacitor Cst.

The first light emitting control signal may be supplied to the first first light emitting control line E11 during a second period T2 of the i-th frame iF period. When the first light emitting control signal is supplied to the first first light emitting control line E11, the fourth transistor M4, the first transistor M1', and the third transistor M3' may be turned on.

When the fourth transistor M4 is turned on, the first driving transistor MD1 and the first organic light emitting diode OLED1 may be electrically coupled. The first driving transistor MD1 may supply a current (e.g., a predetermined current) corresponding to the voltage stored in the storage capacitor Cst to the first organic light emitting diode OLED1. The first organic light emitting diode OLED1 may generate light having a brightness (e.g., predetermined brightness) during the second period T2.

When the third transistor M3' is turned on, the voltage of the first power source ELVDD may be supplied to the second node N2. As a result, the voltage of the second node N2 may be changed from the voltage of the reference power source Vref to the voltage of the first power source ELVDD. When the voltage of the second node N2 is changed, the voltage of the first node N1, which is set to a floating state by coupling of the storage capacitor Cst, may also be changed.

When the first transistor M1' is turned on, the voltage of the initialization power source Vint may be supplied to the anode electrode of the second organic light emitting diode OLED2. The second organic light emitting diode OLED2 may be initialized as a reverse bias state during the second period T2.

The first scan signal may be sequentially supplied to the first scan lines S11 to S1*n* during the i-th frame iF period. Accordingly, the above-described process may be repeated. The first pixels 142 may be driven corresponding to the first data signal DS1 during the i-th frame iF period.

The second scan signal is supplied to the first second scan line S21 during the first period T1' of the (i+1)-th frame (i+1F) period. When the second scan signal is supplied to the first second scan line S21, the second transistor M2' and the fifth transistor M5 may be turned on. When the second transistor M2' is turned on, the second data signal DS2 may be supplied to the second node N2 from the data line D1.

When the fifth transistor M5 is turned on, the voltage of the reference power Vref may be supplied to the first node N1. The storage capacitor Cst may store a voltage corresponding to the difference between the reference power source Vref and the second data signal DS2. A desired voltage may be stored in the storage capacitor Cst in a stable manner, regardless of the voltage drop of the first power source ELVDD.

The second light emitting control signal may be supplied to the first second light emitting control line E21 during the second period T2' of the (i+1)-th frame i+1F period. When the second light emitting control signal is supplied to the first second light emitting control line E21, the fourth transistor M4', the first transistor M1, and the third transistor M3 may be turned on.

When the fourth transistor M4' is turned on, the second driving transistor MD2 and the second organic light emitting diode OLED2 may be electrically coupled. The second driving transistor MD2 may supply a current (e.g., a predetermined current) to the second organic light emitting diode OLED2 corresponding to the voltage stored in the storage capacitor Cst. The second organic light emitting diode OLED2 may generate light having a brightness (e.g., a predetermined brightness) during the second period T2'.

When the third transistor M3 is turned on, the voltage of the first power source ELVDD may be supplied to the first node N1. As a result, the voltage of the first node N1 may be changed to the voltage of the first power source ELVDD from the voltage of the reference power source Vref. When the voltage of the first node N1 is changed, the voltage of the second node N2, which is set to the floating state by the coupling of the storage capacitor Cst, may also change. The voltage stored in the storage capacitor Cst may not change and may maintain the voltage charged during the first period T1'.

When the first transistor M1 is turned on, the voltage of the initialization power source Vint may be supplied to the anode electrode of the first organic light emitting diode OLED1. The first organic light emitting diode OLED1 may be initialized to the reverse bias state during the second period T2'.

The second scan signal may be sequentially supplied to the second scan lines S21 to S2*n* during the (i+1)-th frame i+1F period. The above-described process may be repeated. The second pixels 144 may be driven corresponding to the second data signal DS2 during the (i+1)-th frame i+1F period.

The first organic light emitting diode OLED1 included in the first pixel 142 and the second organic light emitting diode OLED2 included in the second pixel 144 may be alternatively driven with respect to a frame. When the first pixel 142 and the second pixel 144 are alternatively driven with respect to a frame, degradation of the organic light emitting diodes OLED1 and OLED2 and the transistors may be minimized or reduced, thereby improving lifespan. Additionally, the degradation characteristics may be improved by applying the reverse bias voltage of the first organic light emitting diode and the second organic light emitting diode. The first pixel 142 and the second pixel 144 that are adjacent to each other may share the storage capacitor Cst, and accordingly, an area occupied by the first pixel 142 and the second pixel 144 may be minimized or reduced.

Figure 4:
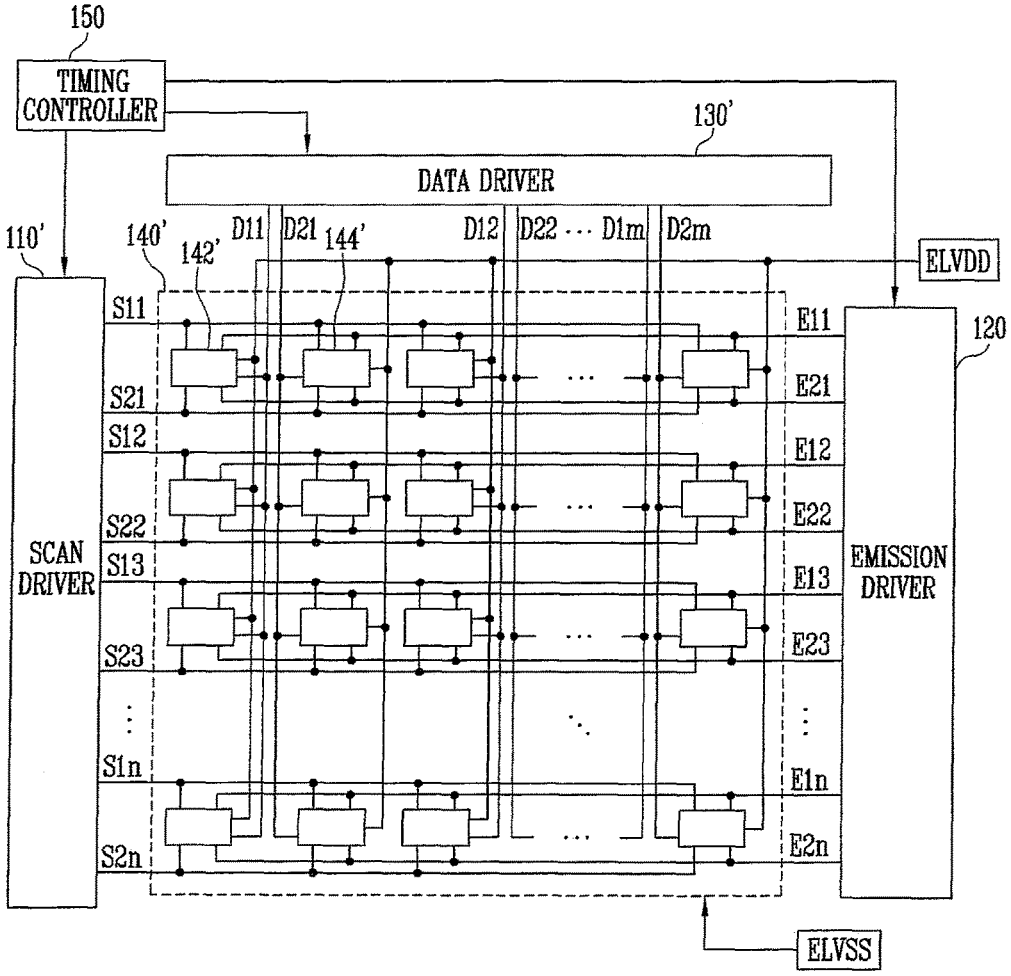
FIG. 4 illustrates an organic light emitting display according to a second embodiment.

FIG. 4 illustrates an organic light emitting display according to a second embodiment. In describing FIG. 4, the same or substantially the same elements and configurations as that shown in FIG. 1 are accorded the same reference numerals, and therefore, repeated description thereof may be omitted.

Referring to FIG. 4, the organic light emitting display according to the second embodiment may include a scan driver 110', an emission driver 120, a data driver 130', a display unit 140' including first pixels 142' and second pixels 144', and a timing controller 150.

The scan driver 110' may sequentially supply first scan signals to first scan lines S11 to S1*n* and second scan signals to second scan lines S21 to S2*n*. A first scan signal supplied to a j-th first scan line S1*j* may be supplied so that it is synchronized with a second scan signal supplied to a j-th second scan line S2*j*.

The data driver 130' may drive first data lines D11 to D1*m* and second data lines D21 to D2*m*. The first data lines D11 to D1*m* may be formed in (e.g., extending in) a vertical direction, and may be coupled to the first pixels 142'. The second data lines D21 to D2*m* may be formed in (e.g., extending in) a vertical direction, and may be coupled to the second pixels 144'.

The data driver 130' may supply first data signals to the first data lines D11 to D1*m* during an i-th frame period, and may supply black data signals to the second data lines D21 to D2*m*. The first data signals may refer to data signals corresponding to gray levels (e.g., grayscale values), and the black data signals may refer to a data signal corresponding to a black gray level (e.g., a black grayscale value).

The data driver 130' may supply second data signals to the second data lines D21 to D2*m* during an (i+1)-th frame period, and may supply the black data signals to the first data lines D11 to D1*m*. The second data signals may refer to data signals corresponding to gray levels (e.g., grayscale values).

The display unit 140' may include the first pixels 142' and the second pixels 144' configured to emit light alternatively with respect to a frame (e.g., one frame period). The first pixels 142' may emit light corresponding to the first data signals supplied during the i-th frame period, and the second pixels 144' may emit light corresponding to the second data signals input during the (i+1)-th frame period. The first pixel 142' and the second pixel 144' that are adjacent to each other may share a storage capacitor configured to store data signals.

Figure 5:
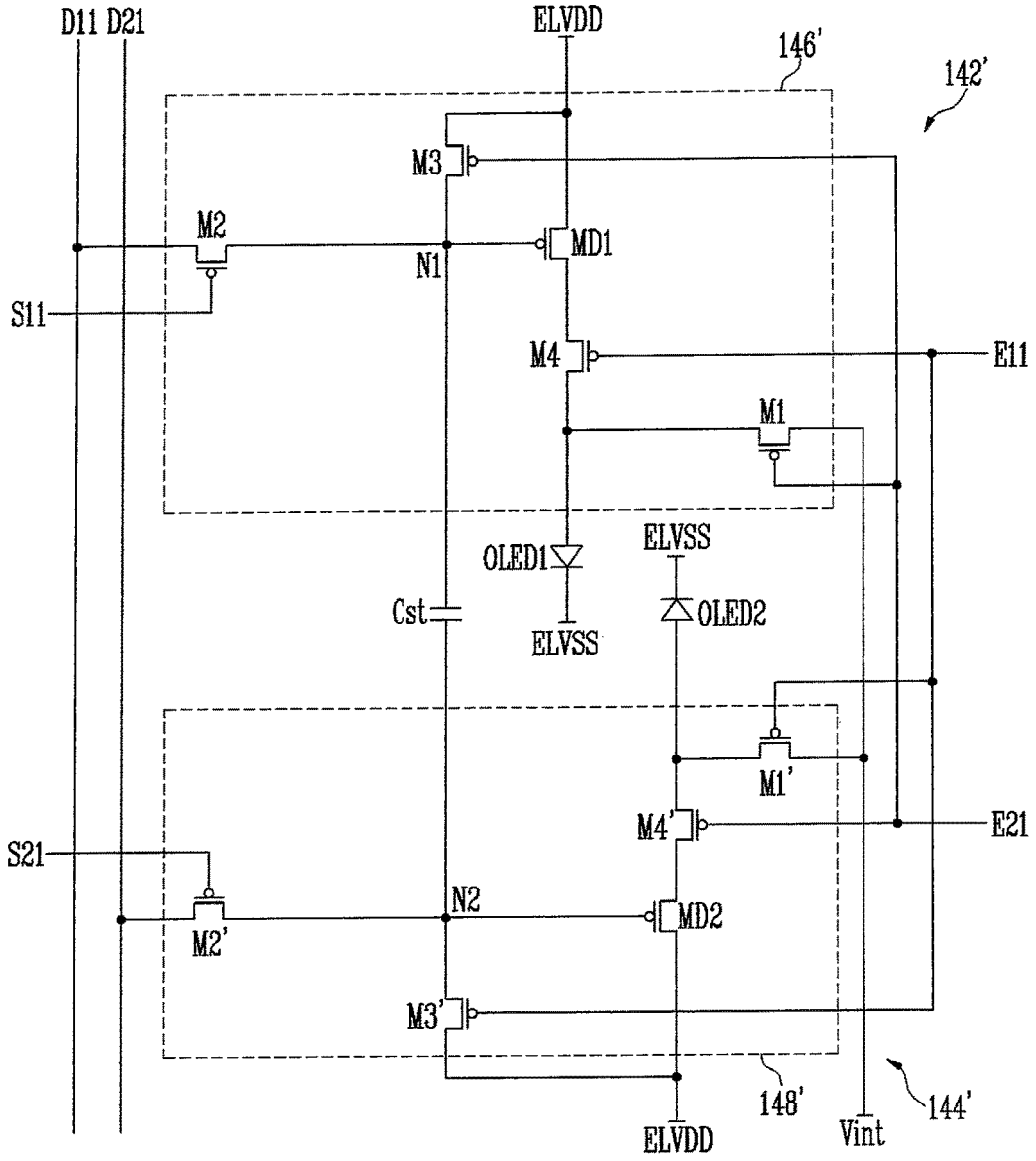
FIG. 5 is a circuit diagram illustrating configurations of a first pixel and a second pixel according to the second embodiment.

FIG. 5 is a circuit diagram illustrating configurations of a first pixel and a second pixel according to the second embodiment. In describing FIG. 5, description relating to the same or substantially the same elements and configurations as that shown in FIG. 2 may be omitted.

Referring to FIG. 5, the first pixel 142' according to the second embodiment may include a first pixel circuit 146' and a first organic light emitting diode OLED1, and the second pixel 144' may include a second pixel circuit 148' and a second organic light emitting diode OLED2.

The first pixel circuit 146' may control an amount of current supplied to the first organic light emitting diode OLED1 corresponding to a first data signal supplied from a first data line D11. A second transistor M2 included in the first pixel circuit 146' may be coupled between a first node N1 and the first data line D11.

The second pixel circuit 148' may control an amount of current supplied to the second organic light emitting diode OLED2 corresponding to a second data signal supplied from a second data line D21. The second transistor M2' included in the second pixel circuit 148' may be coupled between a second node N2 and the second data line D21.

The pixels 142' and 144' according to the second embodiment may charge a voltage in a storage capacitor Cst using a black data signal. From the pixels 142' and 144' according to the second embodiment, the reference power source Vref and the fifth transistors M5 and M5' coupled to the reference power source Vref may be omitted when compared to the pixels 142 and 144 shown in FIG. 2.

Figure 6A:
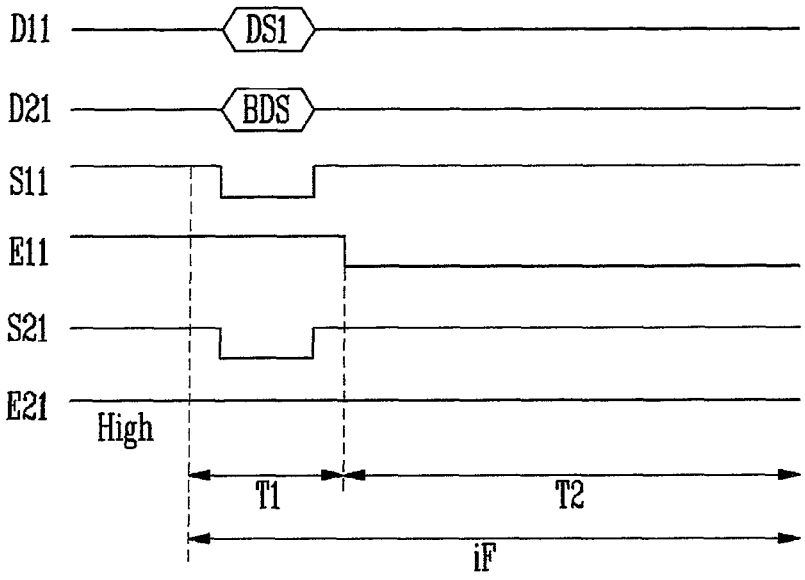
FIGS. 6A and 6B are timing diagrams illustrating a method for driving the first pixel and the second pixel shown in FIG. 5.
Figure 6B:
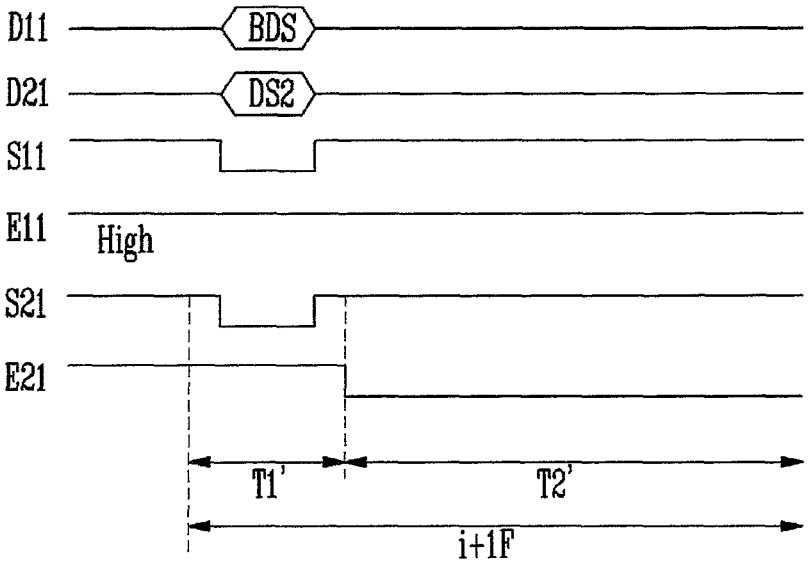

FIGS. 6A and 6B are timing diagrams illustrating a method for driving the first pixel and the second pixel shown in FIG. 5. FIG. 6A is a timing diagram supplied during an i-th frame iF period, and FIG. 6B is a timing diagram supplied during an (i+1)-th frame i+1F period.

During the i-th frame iF period, a first scan signal may be supplied to a first first scan line S11, and a second scan signal may be supplied to a first second scan line S21. When the first scan signal is supplied to the first first scan line S11, the second transistor M2 may be turned on. When the second transistor M2 is turned on, a first data signal DS1 from the first data line D11 may be supplied to the first node N1. When the second scan signal is supplied to the first second scan line S21, the second transistor M2' may be turned on. When the second transistor M2' is turned on, a black data signal BDS from the second data line D21 may be supplied to the second node N2. The black data signal BDS may be set to a voltage that is greater than or equal to that of a first power source ELVDD.

The storage capacitor Cst may store a voltage corresponding to a difference between the black data signal BDS and the first data signal DS1 during a first period T1. The voltage stored in the storage capacitor Cst may be determined regardless of a voltage drop of the first power source ELVDD. Accordingly, a desired voltage may be stored in the storage capacitor Cst in a stable manner.

A first light emitting control signal may be supplied to a first first light emitting control line E11 during a second period T2 of the i-th frame iF period. When the first light emitting control signal is supplied to the first first light emitting control line E11, a fourth transistor M4, a first transistor M1' and a third transistor M3' may be turned on.

When the fourth transistor M4 is turned on, a first driving transistor MD1 and the first organic light emitting diode OLED1 may be electrically coupled. The first driving transistor MD1 may supply a current (e.g., a predetermined current) to the first organic light emitting diode OLED1 corresponding to the voltage stored in the storage capacitor Cst. The first organic light emitting diode OLED1 may generate light having a brightness (e.g., a predetermined brightness) during the second period T2.

When the third transistor M3' is turned on, the voltage of the first power source ELVDD may be supplied to the second node N2. A voltage of the second node N2 may change from a voltage of the black data signal BDS to the voltage of the first power source ELVDD. When the voltage of the second node N2 changes, a voltage of the first node N1, which is set to a floating state by coupling of the storage capacitor Cst, may also change. Here, the voltage stored in the storage capacitor Cst may not change and may maintain the voltage charged during the first period T1.

When the first transistor M1' is turned on, a voltage of an initialization power source Vint may be supplied to an anode electrode of the second organic light emitting diode OLED2. The second organic light emitting diode OLED2 may be initialized to a reverse bias state during the second period T2.

The first scan signals may be sequentially supplied to first scan lines S11 to S1*n* during the i-th frame iF period. The second scan signals may be sequentially supplied to the second scan lines S21 to S2*n*. The above-described process may be repeated. Accordingly, the first pixels 142' may be driven corresponding to the first data signals DS1 during the i-th frame iF period.

The first scan signal may be supplied to the first first scan line S11, and the second scan signal may be supplied to the first second scan line S21 during the first period T1' of the (i+1)-th frame i+1F period. When the first scan signal is supplied to the first first scan line S11, the second transistor M2 may be turned on. When the second transistor M2 is turned on, the black data signal BDS from the first data line D11 may be supplied to the first node N1. When the second scan signal is supplied to the first second scan line S21, the second transistor M2' may be turned on. When the second transistor M2' is turned on, a second data signal DS2 from the second data line D21 may be supplied to the second node N2. The storage capacitor Cst may store a voltage corresponding to a difference between the black data signal BDS and the second data signal DS2.

The second light emitting control signal may be supplied to a first second light emitting control line E21 during the second period T2' of the (i+1)-th frame i+1F period. When the second light emitting control signal is supplied to the first second light emitting control line E21, the fourth transistor M4', the first transistor M1 and the third transistor M3 may be turned on.

When the fourth transistor M4' is turned on, a second driving transistor MD2 and the second organic light emitting diode OLED2 may be electrically coupled. The second driving transistor MD2 may supply a current (e.g., a predetermined current) to the second organic light emitting diode OLED2 corresponding to the voltage stored in the storage capacitor Cst. The second organic light emitting diode OLED2 may generate light having a brightness (e.g., a predetermined brightness) during the second period T2'.

When the third transistor M3 is turned on, the voltage of the first power source ELVDD may be supplied to the first node N1. The voltage of the first node N1 may change from the voltage of the black data signal BDS to the voltage of the first power source ELVDD. When the voltage of the first node N1 changes, the voltage of the second node N2, which is set to the floating state by the coupling of the storage capacitor Cst, may also change. The voltage stored in the storage capacitor Cst may not change, and may maintain the voltage charged during the first period T1'.

When the first transistor M1 is turned on, the voltage of the initialization power source Vint may be supplied to an anode electrode of the first organic light emitting diode OLED1. The first organic light emitting diode OLED1 may be initialized to a reverse bias state during the second period T2'.

The above-described process may be repeated while the first scan signals are sequentially supplied to the first scan lines S11 to S1*n* and the second scan signals are sequentially supplied to the second scan lines S21 to S2*n*. The second pixels 144' may be driven corresponding to the second data signals DS2 during the (i+1)-th frame i+1F period.

For convenience of illustration, the transistors are illustrated as p-channel metal oxide semiconductors (PMOS), but the present invention is not limited thereto. In other words, the transistors may be formed as n-channel metal oxide semiconductors (NMOS).

Furthermore, the OLEDs may generate red, green, blue or white light depending on a current. When the OLEDs generate the white light, it is possible to implement a color image by using an additional color filter.

By way of summation and review, the organic light emitting display may include a plurality of pixels that are arranged in a matrix form at intersections (or crossing regions) of data lines, scan lines, and power lines. The pixels generally include an OLED, two or more transistors including a driving transistor, and one or more capacitors.

The organic light emitting diode and the driving transistor included in the pixel may be gradually degraded corresponding to the time being used. When the organic light emitting diode and the driving transistor are degraded, the image with the desired brightness may no longer be displayed. Therefore, a method for improving lifespan of the organic light emitting display is desired.

The organic light emitting display and the driving method thereof according to an embodiment may drive the first pixels and the second pixels alternatively. The degradation of the first organic light emitting diode included in the first pixels, the second organic light emitting diode included in the second pixels, and the transistors included in the first pixels and the second pixels are minimized or reduced, thereby enhancing lifespan. Additionally, the first organic light emitting diode and the second organic light emitting diode may be applied with a reverse bias voltage, thereby improving degradation characteristics. Also, the first pixel and the second pixel that are adjacent to each other may share the storage capacitor and thereby securing a sufficient opening ratio (e.g., an aperture ratio) for the display device.

Example embodiments have been disclosed herein, and although specific terms are employed, they are used and are to be interpreted in a generic and descriptive sense only, and not for purposes of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments, unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display comprising:

a first pixel comprising a first driving transistor;

a second pixel adjacent to the first pixel and comprising a second driving transistor, the second pixel being configured to emit light at a different time from the first pixel; and a storage capacitor configured to store a voltage of a data signal, the storage capacitor comprising a first electrode directly connected to a gate of the first driving transistor through a first node and a second electrode directly connected to a gate of the second driving transistor through a second node.

2. The organic light emitting display of claim 1, wherein the first pixel and the second pixel are configured to emit light alternatively with respect to a frame.

3. The organic light emitting display of claim 1, further comprising:

a scan driver configured to supply a first scan signal to a first scan line coupled to the first pixel and the second pixel, and to supply a second scan signal to a second scan line coupled to the first pixel and the second pixel;

an emission driver configured to supply a first light emitting control signal to a first light emitting control line coupled to the first pixel and the second pixel, and to supply a second light emitting control signal to a second light emitting control line coupled to the first pixel and the second pixel; and a data driver configured to supply the data signal to a data line coupled to the first pixel and the second pixel.

4. The organic light emitting display of claim 3, wherein the scan driver is configured to supply the first scan signal to the first scan line during an i-th frame period, where i is an odd or even number, and to supply the second scan signal to the second scan line during an (i+1)-th frame period.

5. The organic light emitting display of claim 4, wherein the emission driver is configured to supply the first light emitting control signal to the first light emitting control line after the first scan signal is supplied, and to supply the second light emitting control signal to the second light emitting control line after the second scan signal is supplied.

6. The organic light emitting display of claim 4, wherein the data driver is configured to supply the data signal corresponding to the first pixel to the data line when the first scan signal is supplied, and to supply the data signal corresponding to the second pixel to the data line when the second scan signal is supplied.

7. The organic light emitting display of claim 3, wherein the first pixel comprises a first organic light emitting diode and the first driving transistor of the first pixel is configured to control an amount of current flowing from a first power source to a second power source via the first organic light emitting diode corresponding to a voltage applied to a first node, and wherein the second pixel comprises a second organic light emitting diode and the second driving transistor of the second pixel is configured to control an amount of current flowing from the first power source to the second power source via the second organic light emitting diode corresponding to a voltage applied to a second node.

8. The organic light emitting display of claim 7, wherein the storage capacitor is coupled between the first node and the second node.

9. The organic light emitting display of claim 7, wherein the first pixel further comprises:

a first transistor coupled between an anode electrode of the first organic light emitting diode and an initialization power source set to a voltage lower than that of the second power source, the first transistor being configured to be turned on when the second light emitting control signal is supplied;

a second transistor coupled between the data line and the first node, and configured to be turned on when the first scan signal is supplied;

a third transistor coupled between the first power source and the first node, and configured to be turned on when the second light emitting control signal is supplied;

a fourth transistor coupled between the first driving transistor and the anode electrode of the first light emitting diode, and configured to be turned on when the first light emitting control signal is supplied; and a fifth transistor coupled between a reference power source set to a voltage higher than that of the first power source and the first node, the fifth transistor being configured to be turned on when the second scan signal is supplied.

10. The organic light emitting display of claim 7, wherein the second pixel further comprises:

a first transistor coupled between an anode electrode of the second organic light emitting diode and an initialization power source set to a voltage lower than that of the second power source, the first transistor being configured to be turned on when the first light emitting control signal is supplied;

a second transistor coupled between the data line and the second node, and configured to be turned on when the second scan signal is supplied;

a third transistor coupled between the first power source and the second node, and configured to be turned on when the first light emitting control signal is supplied;

a fourth transistor coupled between the second driving transistor and the anode electrode of the second organic light emitting diode, and configured to be turned on when the second light emitting control signal is supplied; and a fifth transistor coupled between a reference power source set to a voltage equal to or higher than that of the first power source and the second node, the fifth transistor being configured to be turned on when the first scan signal is supplied.

11. The organic light emitting display of claim 1, further comprising:

a scan driver configured to supply a first scan signal to a first scan line coupled to the first pixel and the second pixel, and to supply a second scan signal to a second scan line coupled to the first pixel and the second pixel;

an emission driver configured to supply a first emitting control signal to a first light emitting control line coupled to the first pixel and the second pixel, and to supply a second light emitting control signal to a second light emitting control line coupled to the first pixel and the second pixel; and a data driver configured to supply a first data signal to a first data line coupled to the first pixel, and to supply a second data signal to a second data line coupled to the second pixel.

12. The organic light emitting display of claim 11, wherein the scan driver is configured to supply the first scan signal to the first scan line during an i-th frame period and an (i+1)-th frame period, where i is an odd or even number, and to supply the second scan signal to the second scan line so that the second scan signal is synchronized with the first scan signal.

13. The organic light emitting display of claim 12, wherein the emission driver is configured to supply the first light emitting control signal to the first light emitting control line after the first scan signal is supplied during the i-th frame period, and to supply the second light emitting control signal to the second light emitting control line after the second scan signal is supplied during the (i+1)-th frame period.

14. The organic light emitting display of claim 12, wherein:

the data driver is configured to supply, during the i-th frame period, the first data signal, corresponding to a desired brightness, to the first data line, and the second data signal, corresponding to a black gray level, to the second data line; and the data driver is configured to supply, during the (i+1)-th frame period, the first data signal, corresponding to the black gray level, to the first data line, and the second data signal, corresponding to the desired brightness, to the second data line.

15. The organic light emitting display of claim 11, wherein the first pixel comprises a first organic light emitting diode and the first driving transistor of the first pixel is configured to control an amount of current flowing from a first power source to a second power source via the first organic light emitting diode corresponding to a voltage applied to a first node, and wherein the second pixel comprises a second organic light emitting diode and the second driving transistor of the second pixel is configured to control an amount of current flowing from the first power source to the second power source via the second organic light emitting diode corresponding to a voltage applied to a second node.

16. The organic light emitting display of claim 15, wherein the storage capacitor is coupled between the first node and the second node.

17. The organic light emitting display of claim 15, wherein the first pixel further comprises:

a first transistor coupled between an anode electrode of the first organic light emitting diode and an initialization power source set to a voltage lower than that of the second power source, the first transistor being configured to be turned on when the second organic light emitting control signal is supplied;

a second transistor coupled between the first data line and the first node, and configured to be turned on when the first scan signal is supplied;

a third transistor coupled between the first power source and the first node, and configured to be turned on when the second light emitting control signal is supplied; and a fourth transistor coupled between the first driving transistor and the anode electrode of the first organic light emitting diode, and configured to be turned on when the first light emitting control signal is supplied.

18. The organic light emitting display of claim 15, wherein the second pixel further comprises:

a first transistor coupled between an anode electrode of the second organic light emitting diode and an initialization power source set to a voltage lower than that of the second power source, the first transistor being configured to be turned on when the first organic light emitting control signal is supplied;

a second transistor coupled between the second data line and the second node, and configured to be turned on when the second scan signal is supplied;

a third transistor coupled between the first power source and the second node, and configured to be turned on when the first light emitting control signal is supplied; and a fourth transistor coupled between the second driving transistor and the anode electrode of the second organic light emitting diode, and configured to be turned on when the second light emitting control signal is supplied.

19. A method of driving an organic light emitting display, the method comprising:

emitting light from a first pixel during an i-th frame period, where i is an odd or even number; and emitting light from a second pixel, sharing a storage capacitor with the first pixel, during an (i+1)-th frame period, the storage capacitor comprising a first electrode directly connected to a gate of a first driving transistor of the first pixel through a first node and a second electrode directly connected to a gate of a second driving transistor of the second pixel through a second node.

20. The method of claim 19, wherein a light emitting time of the first pixel and a light emitting time of the second pixel do not overlap each other.

* * * * *